US007019432B1

(12) United States Patent
Potočnik

(10) Patent No.: US 7,019,432 B1
(45) Date of Patent: Mar. 28, 2006

(54) FLAT COMMUTATOR

(75) Inventor: Jože Potočnik, Idrija (SI)

(73) Assignee: Kolektor Group D.O.O., Idrija (SI)

( * ) Notice: Subject to any disclaimer, the term of this patent is extended or adjusted under 35 U.S.C. 154(b) by 0 days.

(21) Appl. No.: 11/186,689

(22) Filed: Jul. 21, 2005

Related U.S. Application Data

(63) Continuation of application No. PCT/EP04/012020, filed on Oct. 24, 2004.

(51) Int. Cl.
*H01R 39/06* (2006.01)

(52) U.S. Cl. ..... 310/237; 29/597

(58) Field of Classification Search ..... 310/237; 29/597

See application file for complete search history.

(56) References Cited

U.S. PATENT DOCUMENTS

| | | | | |
|---|---|---|---|---|
| 5,157,299 | A | 10/1992 | Gerlach | 310/237 |
| 5,175,463 | A | 12/1992 | Farago et al. | 310/237 |
| 5,255,426 | A | 10/1993 | Farago et al. | 29/597 |
| 5,386,167 | A * | 1/1995 | Strobi | 310/237 |
| 5,400,496 | A * | 3/1995 | Kemmner et al. | 29/597 |
| 5,442,849 | A | 8/1995 | Strobl | 29/597 |
| 5,629,576 | A * | 5/1997 | Shimoyama | 310/237 |
| 5,637,944 | A | 6/1997 | Shimoyama | 310/237 |
| 5,677,588 | A * | 10/1997 | Strobl | 310/237 |
| 5,793,140 | A | 8/1998 | Tuckey | 310/237 |
| 5,912,523 | A * | 6/1999 | Ziegler et al. | 310/237 |
| 5,925,961 | A * | 7/1999 | Sugiyanma | 310/237 |
| 6,114,791 | A | 9/2000 | Ito et al. | 310/233 |
| 6,242,838 | B1 * | 6/2001 | Kiyose et al. | 310/233 |
| 6,259,183 | B1 * | 7/2001 | Hotta et al. | 310/233 |
| 6,359,362 | B1 * | 3/2002 | Schmidt | 310/237 |
| 6,617,743 | B1 * | 9/2003 | Potocnik et al. | 310/237 |

FOREIGN PATENT DOCUMENTS

| | | |
|---|---|---|
| DE | 89 07 045.3 | 12/1989 |
| DE | 89 08 077.7 | 12/1989 |
| DE | 40 28 420 | 3/1992 |
| DE | 196 52 840 | 6/1997 |
| DE | 196 01 863 | 7/1997 |
| DE | 197 13 936 | 11/1997 |
| DE | 197 52 626 | 6/1998 |
| DE | 199 03 921 | 8/1999 |

(Continued)

*Primary Examiner*—Karl Tamai
(74) *Attorney, Agent, or Firm*—Katten Muchin Rosenman LLP

(57) ABSTRACT

In a plane commutator with a support member, a plurality of conductor segments and an equally large number of carbon segments connected interlockingly and electrically conductively to the conductor segments, each carbon segment is provided with an annular projection disposed opposite the brush running surface, the end face of the said projection being in contact with a corresponding annular contact face of the associated conductor segment. The annular contact faces are each surrounded by a contact ring of the conductor segment in question, which segment is in gap-free contact with the associated annular projection. On each conductor segment, there projects a contact pin, which engages without gaps in a corresponding bore of the associated annular projection of the carbon segment in question. Thus the carbon segments are each connected electrically conductively via the outer circumferential face, the annular end face and the inner circumferential face of the annular projection to the conductor segments.

21 Claims, 5 Drawing Sheets

FOREIGN PATENT DOCUMENTS

Figure 1:
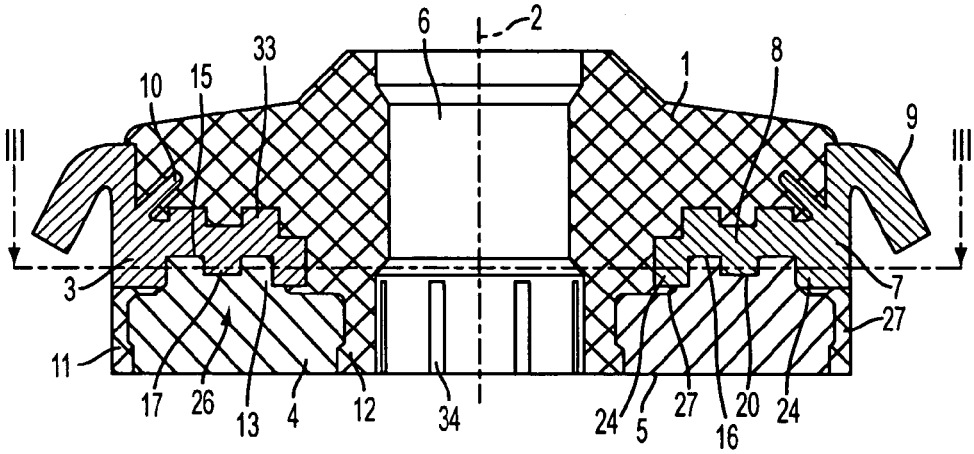

| | | | |
|---|---|---|---|
| DE | 199 56 844 | | 6/2001 |
| DE | 1 363 365 | | 11/2003 |
| EP | 0 583 892 | | 2/1994 |
| EP | 0 667 657 | | 5/1998 |
| EP | 0 935 331 | | 8/1999 |
| EP | 1 001 501 | | 3/2003 |
| FR | 2633781 | * | 7/1989 |
| JP | 8-65966 | | 3/1996 |
| WO | WO 92/01321 | | 1/1992 |
| WO | WO 97/03486 | | 1/1997 |
| WO | WO 00/74181 | | 12/2000 |

* cited by examiner

FLAT COMMUTATOR

CROSS-REFERENCE TO RELATED APPLICATION

This application is a continuation of International Application PCT/EP2004/012020 filed on Oct. 24, 2004, now pending, the contents of which are herein wholly incorporated by reference.

The present invention relates to a plane commutator with a support member made from insulating molding compound, a plurality of conductor segments disposed uniformly around the commutator axis and an equally large number of carbon segments, which are composed of monolithic carbon, which are connected interlockingly and electrically conductively to the conductor segments and which define the brush running surface.

Plane commutators whose brush running surface is defined by the end face of carbon segments are used instead of commutators with a metal brush running surface, especially in a corrosion-favoring environment, such as on drive motors of fuel pumps in motor vehicles. Plane commutators of the class in question are found in numerous different prior art embodiments. Examples to be cited in this connection include German Utility Model 89-08077 U1, European Patent 583892 B1, European Patent 1001501 B1, U.S. Pat. No. 5,175,463 A1, German Utility Model 89-07045 U1, German Patent 19752626 A1, U.S. Pat. No. 5,255,426 A1, German Patent 19652840 A1, International Patent WO 97/03486, German Patent 19601863 A1, German Patent 4028420 A1, European Patent 0667657 A1, U.S. Pat. No. 5,442,849 A1, International Patent WO 92/01321, U.S. Pat. 5,637,944 A1 and German Patent 19713936 A1. Further pertinent prior art is found in U.S. Pat. No. 5,629,576 A1, German Patent 19903921 A1 and European Patent 0935331 A1. The large number of protective rights relating to plane commutators with carbon running surface proves the great need for practical commutators of this design. At the same time, it can be inferred from the large number of publications that numerous groups of problems exist that have not yet been solved to a satisfactory extent.

This is due to the fact among others that different requirements sometimes clash with one another in known plane commutators of the class in question; they include in particular the objectives of suitable overall dimensions, low manufacturing costs, high reliability and long useful life of the commutator, even under particularly unfavorable conditions. For example, the dimensions of the plane commutator compete with its useful life; after all, the wires of the rotor winding are generally welded onto the conductor segments, thus readily leading in particularly small plane commutators to heating-induced damage of the electrically conductive soldered connections of the conductor segments with the carbon segments. This is the background, for example, of proposals to use a high-temperature-resistant silver solder to connect the carbon segments to the conductor segments (see European Patent 0935331 A1) and to dispose the contact points between conductor segments and carbon segments relatively far from the terminals of the rotor winding (see German Patent 19903921 A1); however, the first cited proposal leads to extra costs, and the second cited proposal is associated with reducing the size of the contact points between conductor segments and carbon segments, in turn leading to an unfavorable current-density distribution inside the carbon segments. Other proposals to solve this problem are aimed at reducing heat transfer from the terminal lugs to the contact points between the conductor segments and carbon segments (German Patent 19956844 A1) or at connecting the carbon segments and the associated conductor segments to one another by interlocking means, either exclusively or at least in addition to a soldered joint. In this sense, for example, German Patent 19713936 A1 and U.S. Pat. No. 2001/0024074 A1, which disclose plane commutators having the design of the class in question, each propose that the carbon segments be provided on their end face disposed opposite the brush running surface with peg-like projections, which engage in an opening of the associated conductor segments. According to comparable European Patent 1001501 B1, it is additionally provided that the end portions of those projections protruding from the conductor segments be mechanically deformed by upsetting, in order to clamp the carbon segments as firmly as possible on the conductor segments. For this purpose, the carbon segments are constructed of two layers with different material composition, in that the projections and the respective zones of the carbon segments adjoining them, in contrast to the regions adjoining the brush running surface, are composed of a metal-containing carbon. This favors not only the deformability of the projections but also the current-density distribution inside the carbon segments. However, the production of such two-layer carbon elements is relatively expensive. This disadvantage does not exist in the known plane commutators of the class in question having carbon segments of "monolithic carbon". Nevertheless, the fact that contacting of the carbon segments with the conductor segments is then active only over a small area means an unfavorable current-density distribution, in turn leading to overloading of the contacting.

The objective of the present invention is to provide a plane commutator of the type described in the introduction, wherein the disadvantages listed in the foregoing are avoided. It is intended that, although the corresponding plane commutator can be manufactured with relatively small dimensions and for comparatively low costs, it will exhibit a favorable current-density distribution at the transition from the conductor segments to the carbon segments and will have a long useful life.

The object specified in the foregoing is achieved according to claim 1 by a plane commutator of the type mentioned in the introduction and having the following features:

each carbon segment is provided with an annular projection disposed opposite the brush running surface, the annular end face of the said projection being in contact with a corresponding annular contact face of the associated conductor segment;

the annular contact faces are each surrounded by a contact ring of the conductor segment in question, which segment is in gap-free contact with the associated annular projection in the region of the outer circumferential surface thereof; on each conductor segment, there projects a contact pin surrounded by the annular contact face, which pin engages without gaps in a corresponding bore of the associated annular projection of the carbon segment in question in such a way that the carbon segments are each connected electrically conductively via the outer circumferential face, the annular end face and the inner circumferential face of the annular projection to the conductor segments;

the faces of the contact rings used for connection to the carbon segments, the annular contact faces and the outer circumferential faces of the contact pins are provided with an oxidation-resistant and corrosion-resistant finish.

A further proposed solution is presented in claim 19, which, building on the same bases as claim 1, has as its subject matter a plane commutator that, compared with the solution according to claim 1, differs by another embodiment of the parts of the conductor segments in contact with the annular projections of the carbon segments in the region of the outer circumferential surfaces thereof, in that the conductor segments, instead of having an encircling closed contact ring, are each provided with a plurality of contact projections spaced apart from one another, wherein the molding compound of the support member bears against the outer circumferential faces of the annular projections of the carbon segments in the region of the openings of the molding compound that are present between each two mutually adjacent contact projections. Although the present invention is explained hereinafter on the basis of the solution shown in claim 1, the invention is not to be construed as being limited to such a plane commutator; to the contrary, the viewpoints explained hereinafter, including the advantages of preferred improvements, can also be applied to the solution according to claim 19.

A feature characteristic of inventive plane commutators is the contacting described in the foregoing of each carbon segment with the associated conductor segment in the region of at least three faces, namely the outer circumferential face, the annular end face and the inner circumferential face of the annular projection and, as the case may be, additionally with the bottom face of the bore in the carbon segment. In the first place, this permits particularly large-area contacting of the carbon segments with the conductor segments; consequently, a particularly favorable current-density distribution is obtained at the transition from the conductor segments to the carbon segments and inside the carbon segments, even if these are inexpensively designed as "monolithic carbon", meaning in particular that they do not have several layers and are not composed of carbon mixed with metal particles. In the second place, the contact pins of the conductor segments that each engage in a corresponding bore of the annular projection of the associated carbon segments, possibly as far as making contact with their end face at the bottom face of the bore of the carbon segment, in conjunction with the other features characteristic of the interlocking connection of the carbon segments with the conductor segments, bring about mechanical clamping of the carbon segments together with the conductor segments that is particularly effective, durable, electrically conductive and also capable of withstanding large mechanical loads. A contribution to durable clamping of the carbon segments with the conductor segments is achieved by the fact that, when a conductor blank comprising the conductor segments that are (still) to be connected to one another is joined together with an annular carbon disk comprising the carbon segments that are (still) to be connected to one another, the annular projections of the carbon segments are plastically deformed in the region of their inner and outer circumferential faces and an elastic initial tension is also developed in the interior of the annular projections, leading to a high clamping force and reliable contacting. The plastic deformation of the annular projections of the carbon segments can include in particular penetration of the peripheral zones of the contact rings and of the contact pins of the conductor segments into the original contour of the annular projections, with the result that any surface metallization that may have been present here is rubbed off by the contact rings and contact pins, in such a way that direct contact of the carbon material with the respective contact ring and contact pins is possible. The elastic initial tension exploits the modulus of elasticity of the hardened carbon of the preformed and prehardened projections of the carbon segments. It is critical for production of the initial tension that the projections of the carbon segments be pressed with their end faces against the associated contact faces of the conductor segments during manufacture of the commutator; this is so because in this way the described elastic initial tension can be developed within the annular projections, thus ensuring reliable contacting of the carbon segments with the conductor segments even under fluctuating temperature conditions (−40° C. to 120° C.). In practice, the initial tension in question will be developed in two stages, the first corresponding to joining of the conductor segments and the carbon segments together and the second corresponding to application of the full closing force on the mold in question before injection molding of the support member. The clamping force achievable by the relationships described in the foregoing, with which force the projections of the carbon segments acquire the initial tension for gap-free, electrically conductive contact of the carbon material on the adjoining faces of the contact rings and contact pins of the conductor segments, exceeds even the strength of the carbon material, so that the projections cannot be extracted from the conductor segments.

If, according to a preferred improvement of the invention, the carbon segments do not have any surface metallization, direct gap-free contact with initial tension between the carbon material of the carbon segments and the respective conductor segment is possible even in the region of the end faces of the projections by virtue of the elastic deformation of the projections (see above). This gap-free, end-face contact of the projections of the carbon segments with the associated contact faces of the conductor segments can have particular significance. In this connection, it proves to be particularly favorable in the inventive plane commutator according to claim 1 that the contacting of the carbon segments with the conductor segments in the region of the end faces of the projections is also protected particularly well against aggressive media that may diffuse through the molding compound of the support member; this is so because, with the exception of possible narrow channels in the molding compound (see below), the contacting in question is in each case shielded on all sides from the support member by the contact ring of the conductor segment, which ring bears against the outer surface of the annular projection of the carbon segment and penetrates into the projection.

By virtue of the mechanically durable, completely gap-free, initially tensioned and electrically conductive clamping of the projections of the carbon segments with the conductor segments that is possible according to the invention, there is no need to solder the carbon segments to the conductor segments. In this way, any impairment of the connection in question by subsequent welding of the rotor winding to the commutator is ruled out. And, by elimination of the soldered connection, the inventive commutator can be manufactured inexpensively.

The oxidation-resistant and corrosion-resistant finish of those faces on which the conductor segments contact the respective associated carbon segments is relevant with regard to high reliability of the commutator even under particularly problematic service conditions, for example in contact with fuel containing methanol and ethanol. An improvement of the inventive plane commutators that is preferred in this respect is characterized in that those faces of the contact rings of the conductor segments forming the connection to the carbon segments, the annular contact faces thereof and the outer circumferential faces and if applicable the end faces of the contact pins are coated with an oxidation-resistant and corrosion-resistant metal such as silver, tin or the like. Known and proven coating methods can be used for this purpose. Of course, other options for providing the faces in question with an oxidation-resistant and corrosion-resistant finish can also be used.

According to another preferred improvement of the invention, it is provided that the end faces of the annular projections as well as the surfaces of the carbon segments surrounding the annular projections are provided with mutually connecting metallization, preferably galvanic metallization. In particular, such metallization can have the form of two layers, with a base layer of copper (for example, 4 to 12 μm) and a cover layer of tin (for example, 2 to 6 μm). By the fact that the metallization in each case extends to the surfaces of the carbon segment surrounding the annular projection, the current enters the carbon segments over a large area and so a particularly favorable distribution of current flow is achieved inside the carbon segments.

Yet another preferred improvement of the inventive plane commutator is characterized in that each contact ring is provided in the region of its face serving as connection to the associated carbon segment with at least one molding-compound channel, which ends in the region of the edge formed by the face in question and the annular contact face. During injection molding of the support member, molding compound passes through the molding-compound channels in question to the region of the said edge, where it fills any empty space that may be present there between the conductor segment and the projection of the carbon segment. And, furthermore, in such plane commutators in which the surfaces of the carbon segments of the annular carbon disk have been metallized in the region of the annular projections and the regions surrounding them, this metallization remains undamaged along the molding-compound channels when the annular carbon disk and the conductor blank are being joined together; in this way current-conducting strips that are formed from the metallization and that respectively connect the metallization on the end face of the annular projection with the metallization on the surface of the carbon segment surrounding the projection remain intact in the region of the molding-compound channels. The result of this is particularly reliable and functionally doubled contacting of the conductor segments with the carbon segments. The first contacting takes place via the inner faces of the contact rings and the outer faces of the contact pins, which penetrate into the carbon mass of the annular projections when the annular carbon disk and conductor blank are being joined together; the metallization of the carbon segments is sheared off there by the penetrating contact rings or contact pins. The second contacting takes place via the end faces of the annular projections of the carbon segments that are connected with the contact faces of the conductor segments via an electrically conductive intermediate layer. From here, the current is passed via the current-conducting strips described in the foregoing and the metallization of the regions of the carbon segments surrounding the projections into the said carbon segments over a large area.

Within the scope of the invention, it is provided according to the improvement already indicated in the foregoing that an electrically conductive layer is disposed between the surface-metallized end faces of the annular projections of the carbon segments and the associated contact faces of the conductor segments. The function thereof is in particular to even out the surface roughness of the end faces of the projections of the carbon segments and of the contact faces of the conductor segments and in this way to favor large-area end-face contact of the carbon segments—which are practically non-deformable in the region of their surface metallization—with the conductor segments, while also satisfying practical manufacturing tolerances for the conductor segments and the carbon segments. Furthermore, by virtue of the intermediate layer, a soldered connection can be established between the metallized end faces of the annular projections of the carbon segments and the associated contact faces of the conductor segments. And, by evening out the surface roughness on the two cited faces, the said intermediate layer prevents penetration of molding compound into the contact zone in question during injection molding of the support member. With regard to this function of the electrically conductive intermediate layer, it is preferably composed of an initially powdery or pasty electrically conductive material, which becomes compacted when the annular carbon disk and the conductor blank are joined together. In particular, it has the form of a metal powder, such as tin, that becomes compacted in this way, of a compacted graphite powder, of a compacted mixed powder of metal and graphite or of a cured solder paste. For standard applications of the invention, the thickness of the intermediate layer can be in particular between 0.03 and 0.1 mm. From the viewpoint of manufacturing technology, it is particularly favorable when the material forming the subsequent intermediate layer is applied on the end faces of the projections of the carbon segments by means, for example, of a tampon.

According to yet another preferred improvement of the invention, it is provided that the carbon segments with connecting regions forming electrically conductive connections to the conductor segments are each surrounded by an annular molding-compound layer disposed between the carbon segments and the conductor segments. These annular molding-compound regions externally shield the connecting regions of the carbon segments with the conductor segments, so that they are protected against direct contact with aggressive media. This improvement also proves to be particularly suitable in the case of use of the commutator in a problematic environment.

Yet another preferred improvement of the inventive plane commutator is characterized in that the conductor segments are provided with annular raised structures disposed opposite the annular contact faces and engaging in the support member. This is favorable both for manufacture of the commutator and for use of same. As regards the manufacturing operation in particular, the annular contact faces of the conductor segments can be made particularly inexpensively and efficiently in this improvement of the commutator by axially displacing material of the conductor segments, while these are still joined to one another in the form of a conductor blank, in such a way that it forms the said annular raised structures on the opposite side. These annular raised structures are subsequently embedded in the molding compound of the support member in the course of the further manufacturing process, thus favoring particularly strong mechanical anchoring of the conductor segments in the support member and in this way improving the useful life of the commutator.

According to yet another improvement of the invention, the annular projections have a substantially trapezoidal base shape. This definition also applies to projections in which the radially outer boundary has a substantially arc-like shape. Hereby there is achieved particularly favorable utilization of the area available for the mechanical connection and the electrical contacting of the carbon segments with the conductor segments, in combination with particularly high strength of the connection.

In the scope of the present invention, entirely differently configured embodiments of the annular projections and of the faces of the conductor segments in contact therewith are applicable. In this connection, the specific structural shape can depend, for example, on the size of the commutator and on the exact composition of the material used to make the carbon segments, and especially the corresponding projections. As an example, the faces of the contact rings acting as the connection to the carbon segments can have conical shape, particularly one that tapers toward the annular contact face; preferably, however, they have cylindrical shape. The annular projections of the carbon segments preferably have a frustoconical outer contour; nevertheless, they can also have cylindrical shape. The contact pins can preferably have a substantially round cross section; nevertheless, other cross-sectional shapes are also conceivable, especially when the outer circumferential face of the annular depression deviates particularly strongly from circular shape. The contact pins preferably have cylindrical shape, but even this is not imperative.

Aside from the modifications derived from the features described in the foregoing, the method used for manufacture of plane commutators according to the present invention corresponds to those methods known from the prior art (such as German Patent 19956844 A1). The critical steps of this method are the separate manufacture of a conductor blank, which comprises the conductor segments joined to one another in their final configuration, together with the contact rings, annular contact faces and contact pins, and of an annular carbon disk provided with the annular projections explained in the foregoing. The conductor blank and annular carbon disk are then joined together axially, whereupon the annular projections of the annular carbon disk on the one hand and the contact rings and contact pins of the conductor segments of the conductor blank on the other hand engage mechanically in one another, and are axially pressed firmly together (see above) to form a permanent connection. Molding compound that forms the support member is then injected all around this unit. Finally, the annular carbon disk is subdivided into the individual carbon segments by mechanical machining and the connections of the individual conductor segments of the conductor blank are separated.

From the foregoing explanations about the present invention, it is evident that end-face contact of the projections of the carbon segments with associated contact faces of the conductor segments is particularly relevant to achieving the explained object, since this is significant both for good electrical contacting, especially the functionally double contacting explained hereinabove, and for the described development of tension inside the projections, as is important for mechanical anchoring of the carbon segments. To this extent, the cited object can be achieved in any case, at least in suitable applications (such as particularly small dimensions of the commutator), to a considerable degree even with such commutator constructions that are characterized by elimination of the contact pins but otherwise have the same design features as in the constructions according to claims 1 and 19. The Applicant reserves the right to claim protection for plane commutators configured in such a way, in particular by means of a divisional application.

Figure 2:
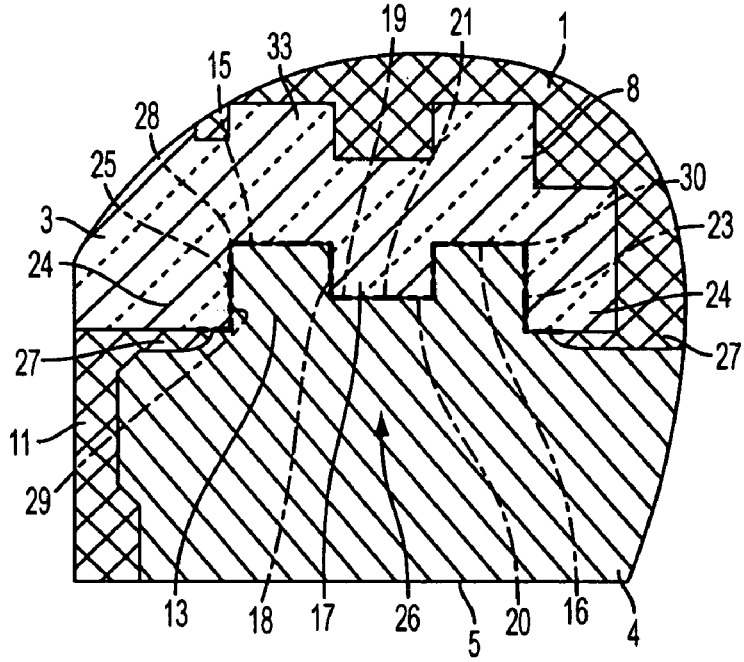
Figure 3:
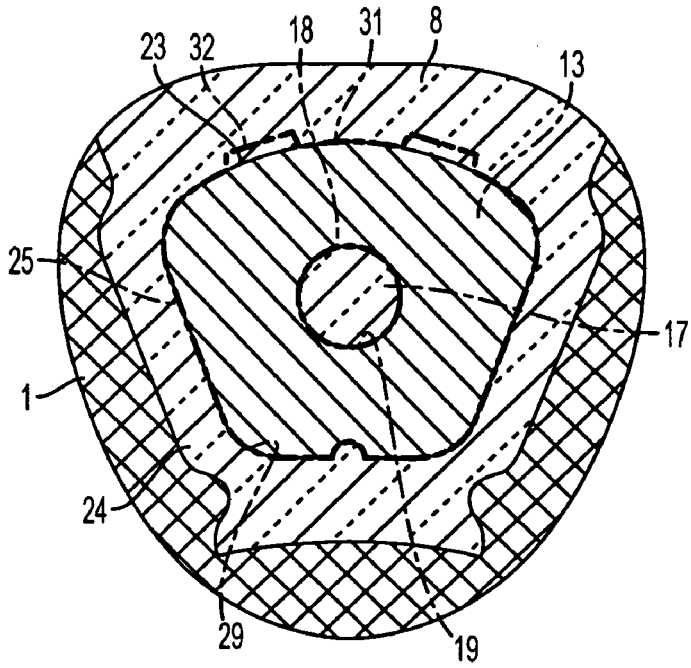
Figure 4:
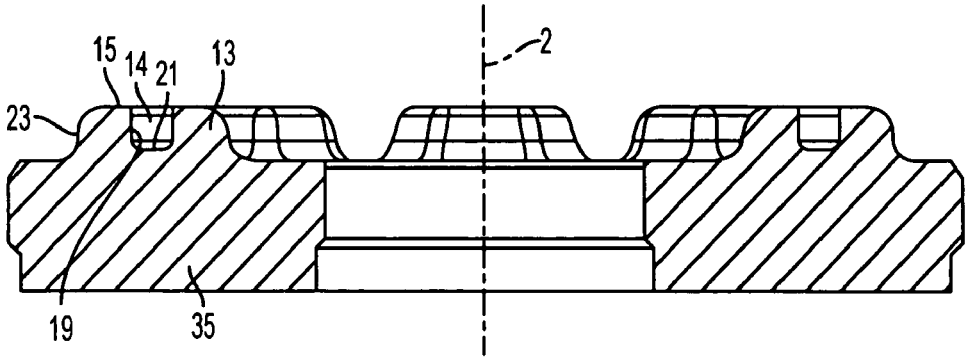
Figure 8:
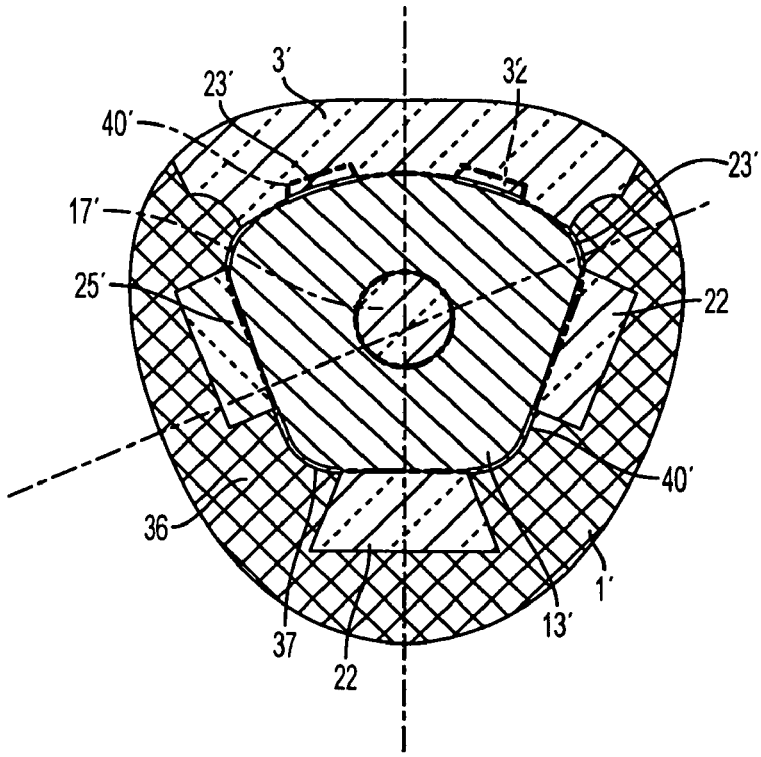
Figure 6:
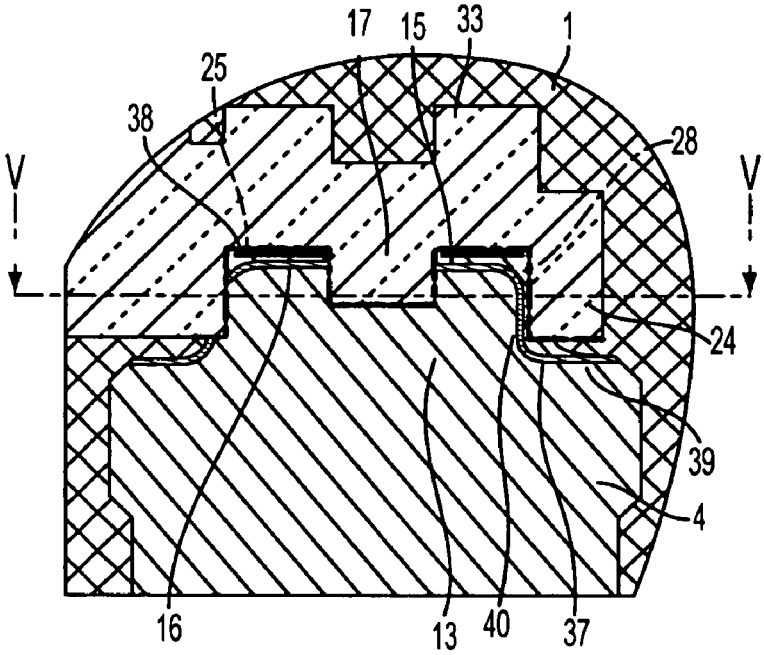
Figure 5:
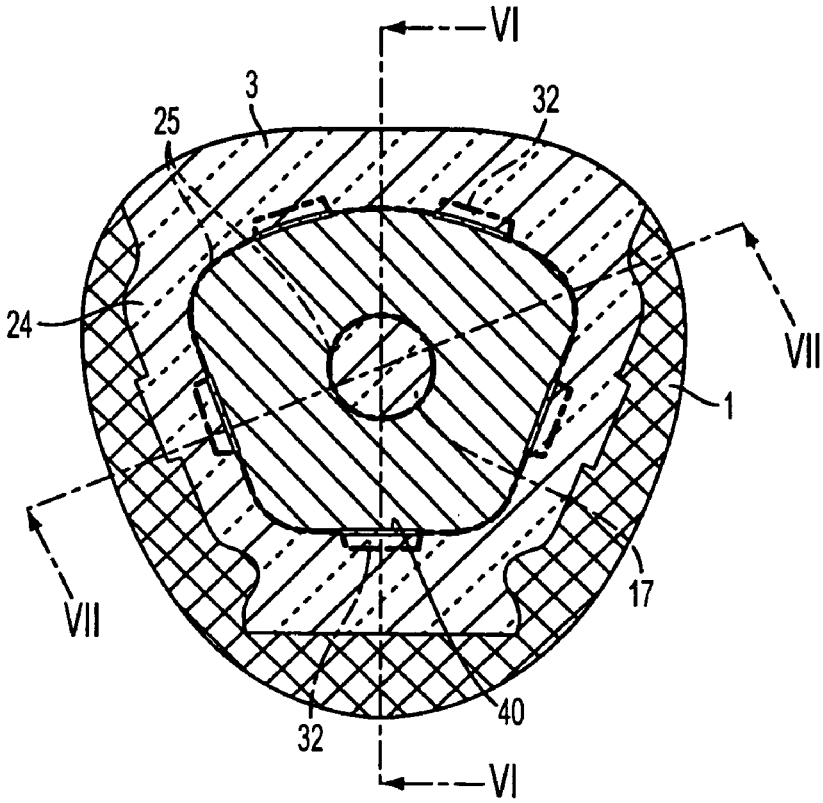
Figure 7:
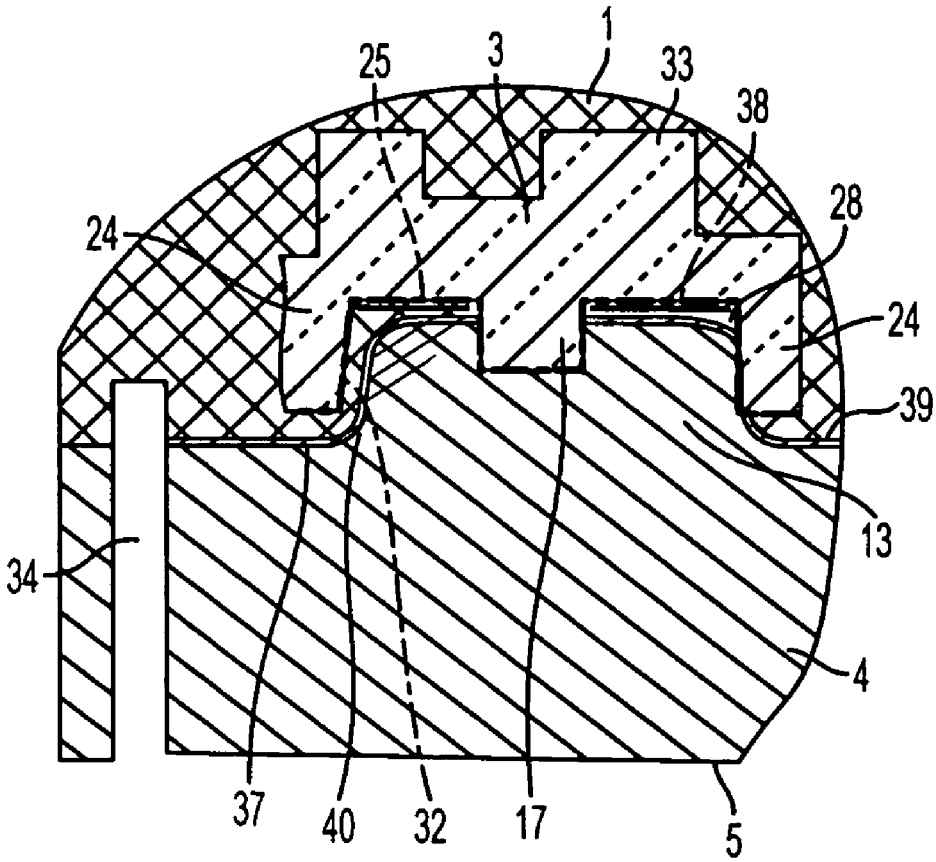

The present invention will be explained in more detail hereinafter on the basis of three practical examples of the inventive plane commutator illustrated in the drawing, wherein FIG. 1 shows an axial section through a first embodiment of a plane commutator according to the present invention, FIG. 2 shows an enlarged view of a connection region between a carbon segment and a conductor segment of the commutator according to FIG. 1, FIG. 3 shows, in a cross section normal to the commutator axis along line III—III, the connection region of a carbon segment and a conductor segment of the commutator according to FIGS. 1 and 2, and FIG. 4 shows, in an axial section, the annular carbon disk used to manufacture the plane commutator according to FIG. 1;

furthermore,

FIG. 5 shows, in a cross section normal to the commutator axis, the connection region of a carbon segment and a conductor segment of a second embodiment of a plane commutator according to the present invention, FIG. 6 shows a section, along line VI—VI, through the connection region of the commutator illustrated in FIG. 5, and FIG. 7 shows a section, along line VII—VII, through the connection region of the commutator illustrated in FIGS. 5 and 6; finally FIG. 8 shows, in a cross section normal to the commutator axis, the connection region of a carbon segment and a conductor segment of a third embodiment of a plane commutator according to the present invention.

The plane commutator illustrated in FIGS. 1 to 4 comprises a support member 1 made of insulating molding compound, eight conductor segments 3 disposed uniformly around axis 2 and eight conductor segments 4, each of which is connected electrically conductively with a conductor segment 3. Carbon segments 4 together define a brush running surface 5 mounted vertically on commutator axis 2. Support member 1 has a central bore 6.

Conductor segments 3 made of copper are produced from a common conductor blank. They each have a terminal zone 7 and a contact zone 8. A contact lug 9 is disposed on each terminal zone 7. This is used for the electrically conductive connection of a winding wire of a rotor winding to conductor segment 3 in question. For better anchoring of conductor segments 3 in support member 1, a holding claw 10 extends obliquely inward from the terminal zones 7 of each conductor segment 3.

Carbon segments 4 are each covered on their radially outer circumferential faces by a molding-compound jacket 11 of support member 1. Because of a stepped construction of the outer circumferential face of carbon segments 4, an interlocking connection with the respective molding-compound jacket 11 is achieved. The molding compound of support member 1 also covers, in the form of a respective molding-compound collar 12, the radially inner circumferential faces of carbon segments 4. Here also an interlocking connection is achieved by virtue of a stepped construction of the radially inner circumferential faces of carbon segments 4. The interlocking connections of carbon segments 4 with support member 1 in the region of their radially inner and outer circumferential faces ensures durable retention of the carbon segments in support member 1.

To this extent, the plane commutator according to the drawing corresponds to the prior art (such as German Patent 19956844 A1), and so the basic structure does not have to be described in detail.

Each carbon segment 4 is provided with an annular projection 13 having a bore 14 and being disposed opposite brush running surface 5. Each projection 13 bears with its annular end face 15 on a corresponding annular contact face 16 of associated conductor segment 3. Round, cylindrical contact pin 17 of conductor segment 3 is surrounded by this annular contact face 16 and engages in bore 14 of annular projection 13 of the carbon segment 4 in question, such that an electrically conductive connection with the inner circumferential face 19 of annular projection 13 is formed in the region of circumferential face 18 of contact pin 17 and an electrically conductive connection to bottom face 21 of bore 14 is formed in the region of end face 20 of contact pin 17. Externally, each contact face 16 is surrounded by a closed contact ring 24, which bears electrically conductively on outer circumferential face 23 of associated annular projection 13 or partly penetrates therein.

Annular projections 13 and contact rings 24 corresponding thereto are each provided (see FIG. 3) with a substantially trapezoidal base shape. By virtue of the tension developed in annular projections 13 during manufacture of the commutator, each carbon segment 4 is connected electrically conductively and without gaps to associated conductor segment 3 via four faces, namely via outer circumferential face 23, annular end face 15 and inner circumferential face 19 of annular projection 13 as well as via bottom face 21 of bore 14 in contact with end face 20 of contact pin 17.

The cited four faces of conductor segment 3 used for contacting with the carbon segment are each coated with a coating 25 of an oxidation-resistant and corrosion-resistant metal such as tin, silver or the like.

Connections regions 26, which each connect carbon segments 4 electrically conductively with conductor segments 3, are each surrounded by an annular molding-compound layer 27 disposed between the carbon segments and the conductor segments. Also filled with molding compound are those empty spaces 28 that are respectively present in the region of edge 30 formed by inner face 29 of contact ring 24 and annular contact face 16 between conductor segment 3 and projection 13—which in this case is rounded (see FIG. 4)—of carbon segment 4. For this purpose, inner faces 29 of contact rings 24 of conductor segments 3 are each provided in their radial outer portion 31 (see FIG. 3) with two molding-compound channels 32, which respectively end in the region of edges 28.

On their side facing away from their respective associated carbon segment 4, conductor segments 3 are provided with an annular raised structure 33 opposite annular contact face 16 and corresponding thereto. These annular raised structures, which were respectively formed by axial displacement of the material injection molded for manufacture of associated annular contact face 16, engage in support member 1.

Radial cuts 34, with which an initially one-piece annular carbon disk 35 (see FIG. 4) was subdivided into individual carbon segments 4 during manufacture of the plane commutator, are also illustrated.

Finally, FIG. 4 further illustrates that outer circumferential faces 23 of annular projections 13 of annular carbon disk 35 are inclined in such a way before being joined together with the conductor blank that the projections taper slightly toward end face 15. When this diagram of annular carbon disk 35 before it is joined together with the conductor blank is compared with the diagrams of the finished plane commutator, especially that of FIG. 2, it is obvious that contact ring 24 penetrates partly into annular projection 13 in the region of its outer circumferential face 23 and that the projection in question thereby becomes plastically deformed in this region. Contact pin 17 also penetrates slightly into the carbon material surrounding bore 14.

The second embodiment of the plane commutator illustrated in FIGS. 5 to 7 is identical to the embodiment according to FIGS. 1 to 4 as regards the critical design features. Thus the foregoing explanations are applicable and do not have to be repeated. The differences are limited substantially to the three viewpoints explained hereinafter:

Thus carbon segments 4 are each provided with surface galvanic metallization 37. Before the annular carbon disk is joined together with the conductor blank, the metallization extends respectively over base face 21 of bore 14, the entire surfaces of annular projection 13 and the surfaces of the carbon segment in question adjoining projection 13. Metallization 37 has two-layer structure with a base layer of copper and a cover layer of tin. When the annular carbon disk and the conductor blank are joined together, however, contact ring 24 and contact pin 17 respectively shear metallization 37 off and penetrate into the non-metallized carbon material. In the region of molding-compound channels 32, however, metallization 37 of carbon segments 4 remains intact, and so zones 39 of metallization 37 located outside projections 13 are respectively connected via current-conducting strips 40, which run inside molding-compound channels 32 and are composed of the metallization remaining therein, to metallization 37 in the region of end face 13. The discontinuity in metallization 37 due to partial penetration of contact rings 24 into projections 13 therefore has no detrimental effects with regard to the distribution of current flow inside the carbon segments.

Furthermore, there is illustrated—with exaggerated thickness—in FIGS. 6 and 7 an electrically conductive intermediate layer 38, which is respectively disposed between end face 15 of projections 13 of carbon segments 4 and contact face 16 of conductor segments 3 and, by virtue of evening out the surface roughness of the two faces in question ensures large-area contact between carbon segments 4 and conductor segments 3 without inclusions of air and/or molding compound in the contact zone.

Finally, in the plane commutator according to FIGS. 5 to 7, there are associated, with each annular projection 13, a total of five molding-compound channels 32, which are disposed radially outward of, radially inward of and on the two faces of contact ring 24 running respectively parallel to radial cuts 34. This feature is related to the function of current-conducting strips 40 running therein (see above).

The third embodiment of the plane commutator illustrated in FIG. 8 differs from that according to FIGS. 5 to 7 substantially only by the fact that conductor segments 3' are provided with four contact projections 22 instead of one contact ring. These surround annular projections 13', engage electrically conductively in the carbon material in the region of outer circumferential faces 23' of annular projections 13' and are separated from one another by openings 36. In the region of the said openings 36 between each two adjacent contact projections 22, the molding compound of support member 1' bears against (metallized) outer circumferential face 23' of annular projection 13' of associated carbon segment 4'. Here, the remaining metallization again forms current-conducting strips 40', just as in the region of the two molding-compound channels 32'.

What is claimed is:

1. A plane commutator with a support member (1) made from insulating molding compound, a plurality of conductor segments (3) disposed uniformly around the commutator axis (2) and an equally large number of carbon segments (4), which are composed of monolithic carbon, which are connected interlockingly and electrically conductively to the conductor segments and which define the brush running surface (5), characterized by the following features:

each carbon segment (4) is provided with an annular projection (13) disposed opposite the brush running surface (5), the annular end face (15) of the said projection being in contact with a corresponding annular contact face (16) of the associated conductor segment (3);

the annular contact faces (16) are each surrounded by a contact ring (24) of the conductor segment (3) in question, which segment is in gap-free contact with the associated annular projection (13) in the region of the outer circumferential surface (23) thereof;

on each conductor segment, there projects a contact pin (17) surrounded by the annular contact face, which pin engages without gaps in a corresponding bore (14) of the associated annular projection (13) of the carbon segment (4) in question in such a way that the carbon segments are each connected electrically conductively via the outer circumferential face (23), the annular end face (15) and the inner circumferential face (19) of the annular projection (13) to the conductor segments (3);

the faces of the contact rings (24) used for connection to the carbon segments (4), the annular contact faces (16) and the outer circumferential faces (18) of the contact pins (17) are provided with an oxidation-resistant and corrosion-resistant finish.

2. A plane commutator according to claim 1, characterized in that the carbon segments (4) are provided with preformed and prehardened annular projections (13), which, by exploiting the modulus of elasticity of the hardened carbon, are subjected to elastic initial tension to make them bear against the outer circumferential faces (18) of the contact pins (17) and the inner circumferential faces of the contact rings (24).

3. A plane commutator according to claim 1, characterized in that the annular projections (13) of the carbon segments (4) do not have any surface metallization and in that the end faces (15) of the annular projections (13), by exploiting the modulus of elasticity of the hardened carbon, are subjected to elastic initial tension to make them bear against the contact faces (16) of the conductor segments (3).

4. A plane commutator according to claim 3, characterized in that the carbon segments are also connected electrically conductively to the conductor segments (3) via the bottom face (21) of the bore (14) in contact with the end face (20) of the contact pin (17).

5. A plane commutator according to claim 1, characterized in that the end faces (15) of the annular projections (13) as well as the surfaces of the carbon segments (4) surrounding the annular projections are provided with metallization.

6. A plane commutator according to claim 5, characterized in that the metallization is formed as galvanic metallization (37).

7. A plane commutator according to claim 5, characterized in that an electrically conductive intermediate layer (38) is disposed between the metallized end faces (15) of the annular projections (13) of the carbon segments (4) and the associated contact faces (16) of the conductor segments (3).

8. A plane commutator according to claim 7, characterized in that the intermediate layer (38) establishes a soldered connection between the metallized end faces (15) of the annular projections (13) of the carbon segments (4) and the associated contact faces (16) of the conductor segments (3).

9. A plane commutator according to claim 8, characterized in that the intermediate layer (38) is composed of a compacted graphite powder, of a compacted mixed powder of metal and graphite or of a cured solder paste.

10. A plane commutator according to claim 7, characterized in that the thickness of the intermediate layer (38) is between 0.03 and 0.1 mm.

11. A plane commutator according to claim 1, characterized in that each contact ring (24) is provided in the region of its face serving as the connection to the projection (13) of the associated carbon segment (4) with at least one molding-compound channel (32), which ends in the region of the edge (30) formed by the face in question of the contact ring (24) and the annular contact face (16).

12. A plane commutator according to claim 5, characterized in that current-conducting strips (40) that are formed from the metallization (37) respectively extend along the molding-compound channels (32) and connect the metallization on the end face (15) of the annular projection (13) with the metallization (39) on the surface of the carbon segment (4) surrounding the projection.

13. A plane commutator according to claim 1, characterized in that the carbon segments (4) with connecting regions (26) forming electrically conductive connections to the conductor segments (3) are each surrounded by an annular molding-compound layer (27) disposed between the carbon segments (4) and the conductor segments (3).

14. A plane commutator according to claim 1, characterized in that the faces of the contact rings (24) serving for connection to the carbon segments (4), the annular contact faces (16) and the outer circumferential faces (18) of the contact pins (17) are coated with an oxidation-resistant and corrosion-resistant metal.

15. A plane commutator according to claim 14, characterized in that the end faces (20) of the contact pins (17) are also coated with an oxidation-resistant and corrosion-resistant metal.

16. A plane commutator according to claim 1, characterized in that the annular projections (13) have a substantially trapezoidal base shape.

17. A plane commutator according to claim 1, characterized in that the faces of the contact rings (24) serving as the connection to the carbon segments (4) have cylindrical shape.

18. A plane commutator according to claim 1, characterized in that the contact pins (17) have a substantially round cross section.

19. A plane commutator according to claim 1,
characterized in that
the contact pins (17) have cylindrical shape.

20. A plane commutator according to claim 1,
characterized in that the conductor segments (3) are provided with annular raised structures (33) disposed opposite the annular contact faces (16) and engaging in the support member (1).

21. A plane commutator with a support member (1') made from insulating molding compound, a plurality of conductor segments (3') disposed uniformly around the commutator axis (2) and an equally large number of carbon segments, which are composed of monolithic carbon, which are connected interlockingly and electrically conductively to the conductor segments and which define the brush running surface, characterized by the following features:

each carbon segment is provided with an annular projection (13') disposed opposite the brush running surface, the annular end face of the said projection being in contact with a corresponding annular contact face of the associated conductor segment (3');

the annular contact faces are each surrounded by a plurality of contact projections (22) of the conductor segment in question spaced apart from one another, the said projections being in direct gap-free contact with the carbon material via the associated annular projection (13') in the region of its outer circumferential face (23');

on each conductor segment, there projects a contact pin (17') surrounded by the annular contact face, which pin engages in a corresponding bore of the associated annular projection (13') of the carbon segment in question in such a way that the carbon segments are each connected electrically conductively via the outer circumferential face (23'), the annular end face and the inner circumferential face of the annular projection (13') to the conductor segments (3');

the molding compound of the support member (1') bears against the outer circumferential faces (23') of the annular projections (13') of the carbon segments in the region of the openings (36) that are present between each two mutually adjacent contact projections (22);

the faces of the contact projections (22) of the conductor segments used for connection to the carbon segments, the annular contact faces and the outer circumferential faces of the contact pins (17') are provided with an oxidation-resistant and corrosion-resistant finish;

the end faces of the annular projections (13') as well as the surfaces of the carbon segments surrounding the annular projections are provided with metallization;

an electrically conductive intermediate layer is disposed between the metallized end faces of the annular projections (13') of the carbon segments and the associated contact faces of the conductor segments (3').

* * * * *